United States Patent [19]

Kästingschäfer et al.

[11] Patent Number: 5,000,392

[45] Date of Patent: Mar. 19, 1991

[54] GRINDING ROLLER

[75] Inventors: Gerhard Kästingschäfer, Wadersloh; Bernhard Peterwerth, Bad Lear, both of Fed. Rep. of Germany

[73] Assignee: Krupp Polysius AG, Fed. Rep. of Germany

[21] Appl. No.: 516,524

[22] Filed: Apr. 30, 1990

[30] Foreign Application Priority Data

May 10, 1989 [DE] Fed. Rep. of Germany ..... 3915320

[51] Int. Cl.[5] ..... B21B 27/02

[52] U.S. Cl. ..... 241/294; 29/124; 29/132

[58] Field of Search ..... 29/124, 125, 130, 132; 241/294

[56] References Cited

U.S. PATENT DOCUMENTS

| | | | |
|---|---|---|---|
| 3,390,839 | 7/1968 | Smith | 241/294 |
| 3,742,852 | 7/1973 | Leffler et al. | 29/125 X |
| 3,760,477 | 9/1973 | Koch | 29/124 |
| 3,989,441 | 11/1976 | Lauterbach | 29/124 X |
| 4,542,566 | 9/1985 | Sukenik | 29/124 X |
| 4,910,845 | 3/1990 | Delhaes | 29/124 |

*Primary Examiner*—Timothy V. Eley

*Attorney, Agent, or Firm*—Learman & McCulloch

[57] ABSTRACT

This grinding roller intended for use in a material bed roller mill comprises a basic body and a roller shell composed of individual firmly clamped segments, and several sheets of softer material which run transversely and are aligned radially are cast into each segment which is made largely from chill casting. In a simple manner this produces a surface profiling of the roller shell which remains approximately constant during the operating life of the segments with improved feeding behavior of the material for grinding.

13 Claims, 4 Drawing Sheets

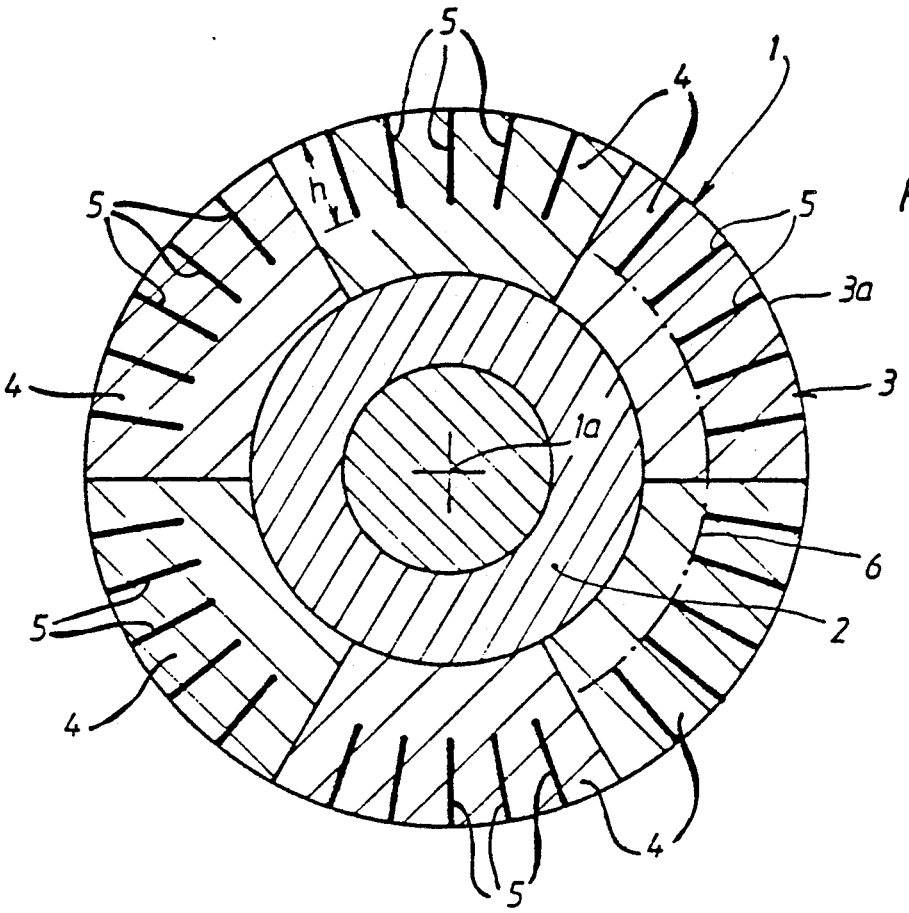
FIG. 1
FIG. 2
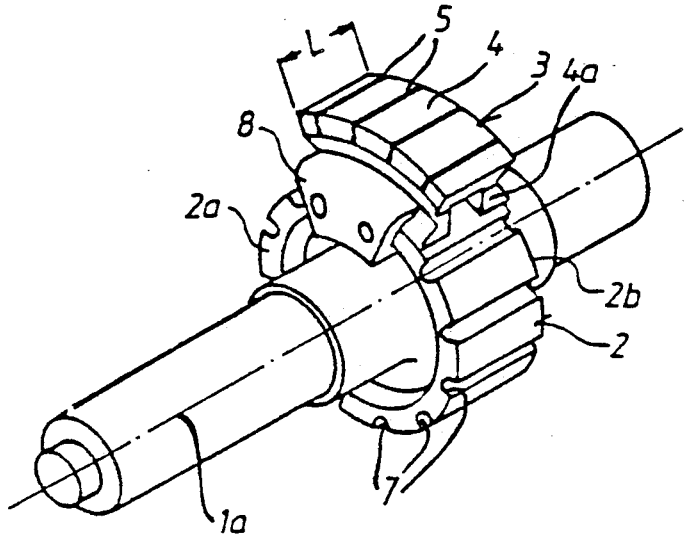

GRINDING ROLLER

The invention relates to a grinding roller, particularly for use in a material bed roller mill, in which brittle material for grinding is crushed between two grinding rollers which are pressed against one another with high pressure, according to the preamble to claim 1.

A grinding roller of the aforesaid type is described for example in an earlier proposal (P 38 33 614.6) for a roller mill which was not prior published. This relates above all to the clamping together of the individual shell segments with the aid of clamping plates which are provided on the end faces of the rollers and clamped with the aid of tightening screws. In this earlier proposal for a roller mill, the wear on the segments occurring during the crushing of brittle material for grinding (for example cement clinker) and in particular the disruptive wear occurring in the region of the end faces of the segments as well as the repair work necessitated thereby are met by an arrangement in which the clamping plates completely cover the end faces of the segments and close them off flush with the outer peripheral surface of the segments.

The object of this invention is to make further developments to a grinding roller of the type set out in the preamble to claim 1 in such a way that with comparatively simple construction it contributes to a particularly good feeding behaviour of the material for grinding which is to be crushed in a roller mill, particularly a material bed roller mill.

This object is achieved according to the invention by the features set out in the characterising portion of claim 1, and advantageous embodiments of this invention are described in the subordinate claims.

Since in the construction of the grinding roller according to the invention several sheets of softer material are cast in the manner mentioned into each segment of the roller shell which is made from hard cast material, even after a very brief grinding operation there is a slight wear on these sheets on the outer peripheral face of the roller shell, so that a resulting outer surface of the shell is produced which is to some extent profiled. This profiled shell surface contributes to a considerably improved feeding behaviour for the material for grinding compared with the smooth-surfaced roller shells which are usually used in material bed roller mills.

In the case of grinding rollers which are used above all for soft milling it is already known for the shell surface to be roughened by separate machining of knurls or to be specifically profiled. However, this knurling of the shell surface of grinding rollers must be repeated from time to time according to any wear occurring on the shell surface, involving corresponding expenditure on assembly and refinishing as well as undesirable downtimes. By contrast, on a grinding roller according to the invention, even in the event of wear of the hard cast material from which the shell segments are made, there is greater wear in a corresponding ratio on the cast sheets so that during the entire operating life of the roller segments the desired surface profiling of the roller shell is maintained, so that the cost of undesirable refinishing, as referred to above, is avoided.

However, the profiling of the surface of the roller shell according to the invention produces a further significant advantage in that the sheets cast into the segments prevent adjacent edges (profiled edges of the cast material breaking off on the segments.

Some embodiments of the invention will be explained in greater detail below with the aid of the drawings, in which:

FIG. 1 shows a cross-section through a grinding roller constructed according to the invention;

FIG. 2 shows a perspective view of a basic roller body with a segment mounted on its periphery;

Figure 3:
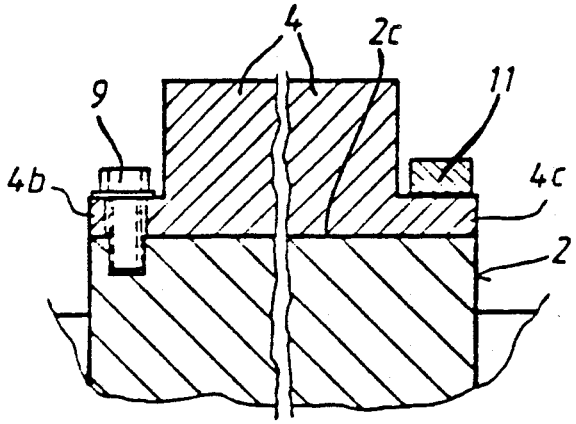
FIGS. 3 and 4 shows respectively a partial longitudinal section and a partial cross-section of two further embodiments, showing the mounting and fixing of segments on the basic roller body.

FIG. 1 shows a cross-section through the grinding roller 1 which is constructed according to the invention, and from this drawing it can be seen that this grinding roller comprises a basic roller body 2 as well as a roller shell 3 which is arranged directly on the basic roller body 2 and is composed of individual—six in the present example—annular segments 4. All six segments 4 are clamped to the roller body 2—preferably so that they lie close together in the peripheral direction of the roller—as will be explained in greater detail below. All segments 4 are constructed in the same shape and the same size, so that they can be replaced individually and exchanged for one another.

Each segment 4 is made largely of hard cast material, preferably from chill casting (cast steel). In this case a suitable number of peripherally spaced sheets 5, which are made from a material which is softer than the chill casting, preferably from substantially non-hardenable steel (structural steel), are cast into each segment 4 of the roller shell 3. These sheets 5 run substantially at right angles to the shell surface 3*a*, and they are—when viewed in cross-section according to FIG. 1—aligned approximately radially with respect to this shell surface 3*a*.

All sheets 5 are preferably constructed in the form of sheet metal strips which run transversely, i.e. substantially in the direction of the longitudinal axis of the roller, and can basically be constructed in any lengths (viewed in the direction of the axial length of the roller) and in any shapes which appear most appropriate in the particular case, i.e. unprofiled or profiled in the longitudinal direction.

The radial height h of these sheets or sheet metal strips 5 can generally be as desired. This radial height of the sheet metal strips 5 cast into the segments 4 will preferably correspond approximately to a predetermined outer wear layer thickness of the roller shell 3, as is indicated in FIG. 1 in the case of two segments 4 by a dash-dot line 6.

FIG. 2 shows in perspective view how one or each segment 4 of the roller shell 3 can be fixed on the basic roller body 2. According to this a correspondingly large number of axially extending grooves 7 of sufficiently large dimensions are provided on the outer peripheral face of the basic roller body 2, and correspondingly profiled clamping plate segments 8 are arranged on the two opposing end faces 2*a*, 2*b* of the basic roller body 2 so that they engage over the inner peripheral faces 4*a*, which are appropriately profiled in each case, of the appertaining shell segment 4. Two clamping plate segments 8 which engage on the two opposing end faces 2*a*, 2*b* of the basic roller body 2 and of the respective segment 4 are then clamped together with the aid of two axially extending tightening screws, which are known per se and are therefore not shown in greater detail, so that they clamp the segments firmly to the basic roller body 2.

Another possible construction for the fixing of the individual segments 4 on the outer peripheral face of the basic roller body 2 is shown in FIG. 3. According to this, each segment 4 is constructed with two fixing flanges 4*b* and 4*c* which are directed axially against one another on the end face, so that these fixing flanges rest suitably on the outer peripheral face 2*c* of the basic roller body 2 and are firmly clamped on this outer peripheral face 2*c* of the basic roller body 2 with the aid of screw bolts 9 (left) or by means of integral clamping rings (11 (right half).

Figure 4:
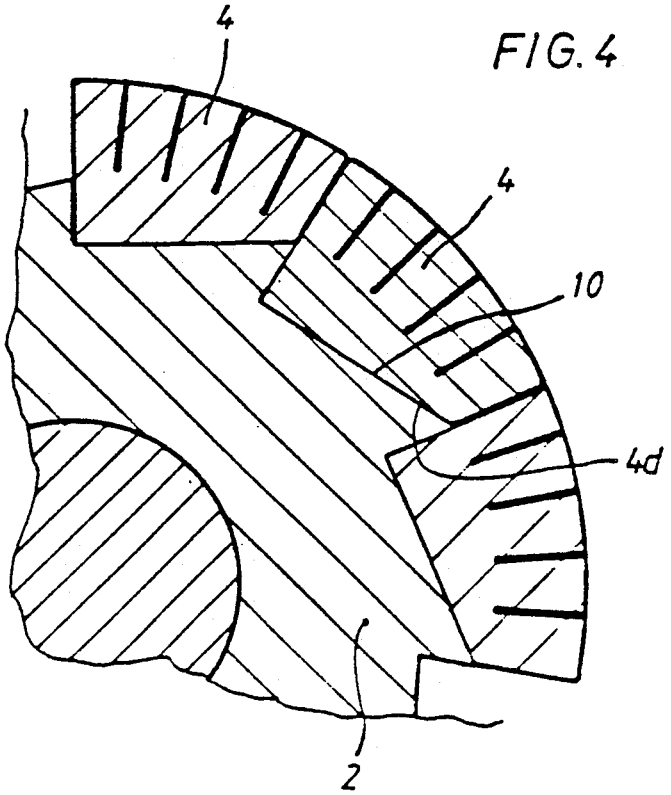

Furthermore, FIG. 4 shows a further possibility in which the basic roller body 2 is constructed to some extent in a sawtooth shape in cross-section on its outer peripheral face, with the appropriately profiled inner face 4*d* of the appertaining segment 4 being inserted so as to fit accurately in each sawtooth-shaped recess 10. The segments 4 can be fixed on the basic roller body 1 in one of the described forms (by means of tightening screws or fixing screws) or in any other suitable manner. Profiling of the outer peripheral face of the basic roller body 2 and the matching profiling of the inner face of each segment 4 has the advantage that the roller shell which is firmly clamped on the basic roller body is fastened reliably on this basic roller body so as to be fixed against rotation.

As has already been mentioned in the introduction, the sheet metal strips 5 made from softer material can be of various constructions and can also be cast in the cast material of the segments 4. A series of possibilities for this can be seen from FIGS. 2 and 5–10.

According to FIG. 2 the sheet metal strips 5 are constructed as straight flat (level) sheet metal strips which extend parallel to the longitudinal roller axis 1*a* over the entire axial length (working length) L of the roller shell 3.

Figure 5:
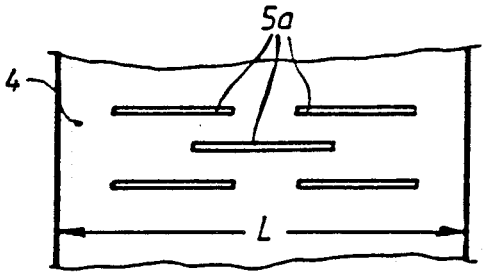
FIGS. 5 to 11 shows partial plan views of the unrolled roller shell in order explain various embodiments of sheets cast into the individual segments.

In the example according to FIG. 5, too, the sheet metal strips 5*a* cast in the segment 4 are constructed so that they run straight and parallel to the longitudinal roller axis. However, in this case the sheet metal strips 5*a* only extend in each case over a part of the axial length L of the roller shell in such a way that in the peripheral sections of the segment 4 containing the sheet metal strips 5*a*, in one peripheral section two such sheet metal strips 5*a* lie behind one another in axial extension and spaced axially from one another, whilst in the peripheral sections which are immediately adjacent in the peripheral direction only one such sheet metal strip 5*a* in each case is arranged approximately in the central longitudinal section of the roller shell or its segment 4. Thus the sheet metal strips 5*a* lie approximately in echelon formation or staggered with respect to one another in adjacent peripheral sections.

Figure 6:
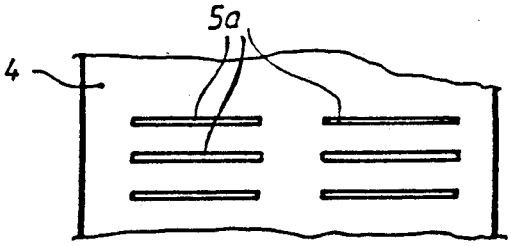

In the example according to FIG. 6 sheet metal strips 5*a* which are constructed in the same way and the same size as in the preceding example (FIG. 5) are provided, but in this case these sheet metal strips 5*a* in each case lie parallel to one another both in the peripheral direction and in the direction of the longitudinal roller axis in the adjacent peripheral sections of the segment 4, and two such straight sheet metal strips 5*a* are arranged in axial extension behind one another in each corresponding peripheral section.

Figure 7:
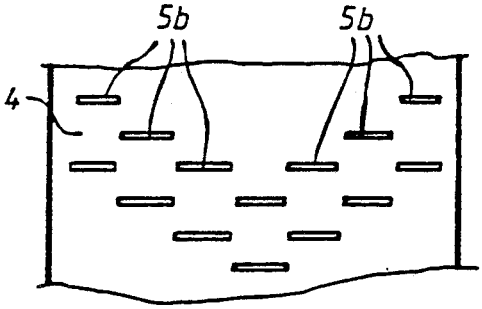

According to the example of FIG. 7, too, several sheet metal strips 5*b* are in each case arranged in axial extension and aligned parallel to the longitudinal roller axis in the adjacent peripheral sections of the segments 4, but in this case the sheet metal strips are of markedly shorter length than in the preceding examples. Moreover, in this case too the sheet metal strips 5*b* which are in each case cast in peripheral sections which are immediately adjacent to one another are arranged in echelon formation or staggered with respect to one another in such a way that the sheet metal strips 5*c* of several adjacent peripheral sections of the individual segments 4 form a relatively flat arrow shape.

Figure 8:
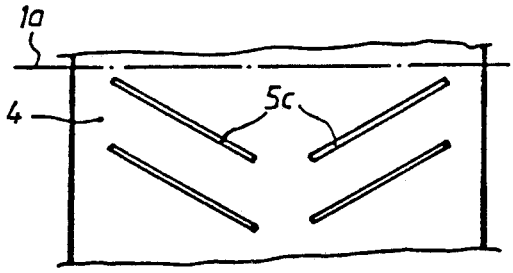

FIG. 8 shows a further embodiment with sheet metal strips 5*c* which extend in a straight line and are of flat construction and whose length corresponds to only a part of the axial length L of the segments 4 or of the roller shell. Again, two such sheet metal strips 5*c* are arranged behind one another in each peripheral section of the segments 4 containing sheet metal strips 5*c*. However, in each of these peripheral sections one sheet metal strip 5*c* is inclined in one direction—with respect to the longitudinal roller axis indicated by a dash-dot line at 1*a*—and the second sheet metal strip 5*c* is inclined in the opposite direction, i.e. the two sheet metal strips 5*c* which are arranged axially behind one another of each corresponding peripheral section are inclined with respect to one another in approximately opposite directions in such a way that—as shown in FIG. 8—they form an approximately flat arrow shape so that their ends adjacent to one another can touch or—as shown—are spaced axially from one another.

Figure 9:
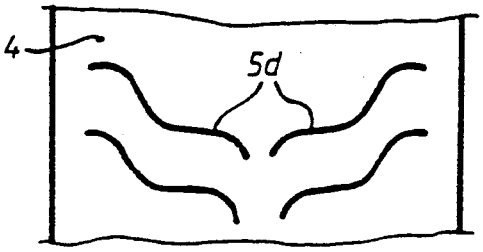

The example according to FIG. 9 shows an arrangement of two sheet metal strips 5*d* in each corresponding peripheral section which is similar in principle to FIG. 8. However, in this case the sheet metal strips 5*d* cast into the individual segments 4 are constructed in each case in such a way that they have a corrugated form in their longitudinal direction, whilst otherwise maintaining a similar flat arrow-shaped assembly as has already been explained with the aid of FIG. 8.

Figure 10:
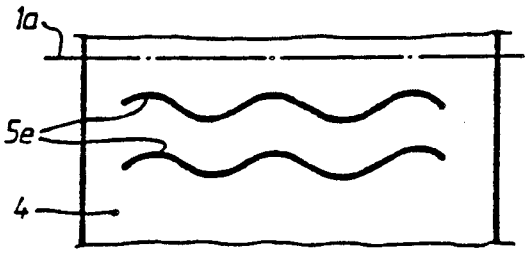

Furthermore, FIG. 10 shows an embodiment in which the sheet metal strips 5*e* of each shell segment 4 also have a corrugated form in their longitudinal direction, but only one such corrugated sheet metal strip 5*e* is arranged in each corresponding peripheral section of the segment 4, the said sheet metal strip 5*e* running substantially in the direction of the longitudinal roller axis 1*a* and extending over the greater part of the axial length of the roller shell or of its segement 4.

Figure 11:
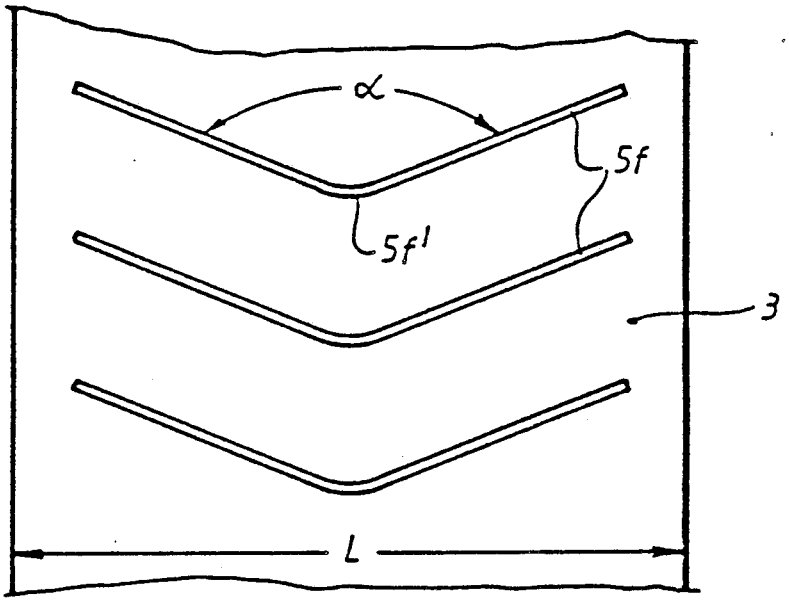

Finally, FIG. 11 also shows an example in which the sheet metal strips 5*f* again extend approximately over the greater part of the axial length L of the roller shell 3 and are arranged with substantially equal spaces between them in the peripheral direction. The special feature of this construction resides in the fact that—as shown in FIG. 11—all similarly constructed sheet metal strips 5*f* have a flat bend, preferably a symmetrical flat angular shape which is approximately arrow-shaped. Thus each sheet metal strip 5*f* encloses a relatively obtuse angle $\alpha$ (also approximately similar to the sheet metal strips 5*c* FIG. 8 or 5*d* in FIG. 9 which in each case lie axially behind one another. Thus the vertex 5*f* of each obtuse angle formed in this way lies approximately on the axial centre of the length of the roller shell 3 and depending upon the application can point in the direction of rotation or opposite to the direction of rotation of the appertaining roller.

The grinding roller constructed according to the invention is particularly suitable for use in a material bed roller mill of the type indicated in the introduction, so that the brittle material for grinding which is to be crushed can be drawn in particularly well and evenly by the two grinding rollers arranged in the material bed roller mill.

We claim:

1. A grinding roller for use in a material bed roller mill in which brittle material for subsequent grinding is crushed between two rollers which are pressed against one another with high pressure, said grinding roller comprising a basic roller body and a roller shell made of a relatively hard cast material and composed of individual segments each including a shell surface, the segments being clamped to the basic roller body, characterized in that several sheets which are made of a relatively softer material than the cast material of said roller shell are cast into each segment of the roller shell, said sheets being arranged so as to be peripherally spaced from one another, and disposed substantially at right angles to said shell surface and aligned approximately radially with respect thereto.

2. A grinding roller as claimed in claim 1, characterized in that sheets are constructed in the form of sheet metal strips which extend aproximately transversely across said shell surface:

3. Grinding roller as claimed in claim 2, characterised in that the sheet metal strips (5) extend over the entire axial length (L) of the roller shell (3).

4. Grinding roller as claimed in claim 3, characterised in that the sheet metal strips (5*a*, 5*b*, 5*c*) in each case extend over only a part of the axial length (L) of the roller shell (3).

5. Grinding roller as claimed in claim 4, characterised in that in the peripheral sections of the individual segments (4) containing the sheet metal strips (5*a*, 5*b*, 5*c*, 5*d*), in each case several sheet metal strips are arranged substantially behind one another in the direction of the longitudinal roller axis (1*a*).

6. Grinding roller as claimed in claim 5, characterised in that the sheet metal strips (5*a*, 5*b*) of each corresponding peripheral section lie behind one another in straight axial extension.

7. Grinding roller as claimed in claim 5, characterised in that the sheet metal strips (5*a*, 5*b*) of each corresponding peripheral section lie axially behind one another approximately in echelon formation.

8. Grinding roller as claimed in claim 5, characterised in that the sheet metal strips (5*c*, 5*d*) of each corresponding peripheral section are inclined with respect to one another in approximately opposite directions—with respect to the longitudinal roller axis (1*a*)—and are arranged axially behind one another so that they form a flat arrow shape.

9. Grinding roller as claimed in claim 2, characterised in that the sheet metal strips (5, 5*a*, 5*b*, 5*c*) are constructed so that they run straight and flat.

10. Grinding roller as claimed in claim 2, characterised in that the sheet metal stips (5*d*, 5*e*) have an approximately corrugated shape in their longitudinal direction.

11. Grinding roller as claimed in claim 1, characterised in that the sheet metal strips (5*f*) which extend at least over the greater part of the axial length (L) of the roller shell (3) and are arranged with substantially equal peripheral spacing between them have a flat bend, and a symmetrical, approximately arrow-shaped angular form.

12. Grinding roller as claimed in claim 1, characterised in that the radial height (h) of the sheets (5) cast into the segments (4) corresponds approximately to a predetermined wear layer thickness of the roller shell (3).

13. Grinding roller as claimed in claim 1, characterised in that the cast material of the segments (9) is a chill casting and the cast sheets (5) are produced from substantially non-hardenable steel, particularly structural steel.

* * * * *